United States Patent [19]

Snellman et al.

[11] 4,273,326

[45] Jun. 16, 1981

[54] COLLATOR

[75] Inventors: Donald L. Snellman; Osceola J. Gerbracht, both of Seattle, Wash.

[73] Assignee: Norfin, Inc., Seattle, Wash.

[21] Appl. No.: 969,383

[22] Filed: Dec. 14, 1978

[51] Int. Cl.[3] ..... B65H 39/11; B65H 29/58; B65H 31/24

[52] U.S. Cl. ..... 271/288; 271/3.1; 271/186; 271/291; 271/296; 271/301; 271/DIG. 9

[58] Field of Search ..... 271/291, 296, DIG. 9, 271/186, 65, 288, 289, 301, 287, 3.1, 4; 242/107; 74/578, 577 M, 577 R, 99 R; 226/51, 49; 185/37

[56] References Cited

U.S. PATENT DOCUMENTS

| | | | |
|---|---|---|---|
| 1,541,651 | 6/1925 | Matlack | 271/DIG. 9 X |
| 3,181,759 | 5/1965 | Maples | 226/51 |
| 3,414,254 | 12/1968 | Snellman et al. | 271/296 |
| 3,414,256 | 12/1968 | Mestre | 271/289 |
| 3,497,207 | 2/1970 | Caldwell et al. | 271/287 |
| 3,848,868 | 11/1974 | Stemmle | 271/291 |
| 3,997,126 | 12/1976 | Karlsson | 242/107 |
| 4,099,150 | 7/1978 | Connin | 271/3.1 X |

*Primary Examiner*—Bruce H. Stoner, Jr.
*Attorney, Agent, or Firm*—Seed, Berry, Vernon & Baynham

[57] ABSTRACT

A rear entry collator which includes one or more sheet receiver bins in which sheets may be assembled in a non-inverted surface orientation with respect to the surface orientation thereof when accepted at infeed. Return sheet feed to a copier may be provided to effect duplex copying separately or in combination with sheet assembly in the receiver bins.

19 Claims, 18 Drawing Figures

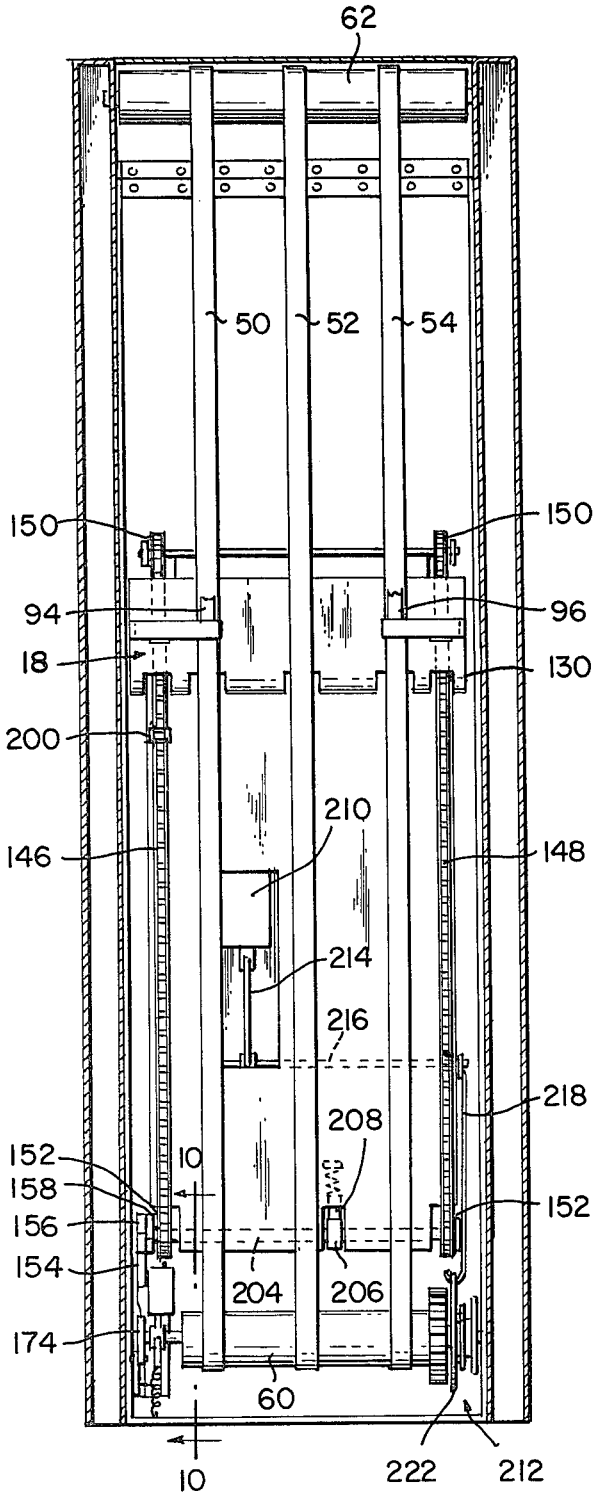
FIG. 7
FIG. 11
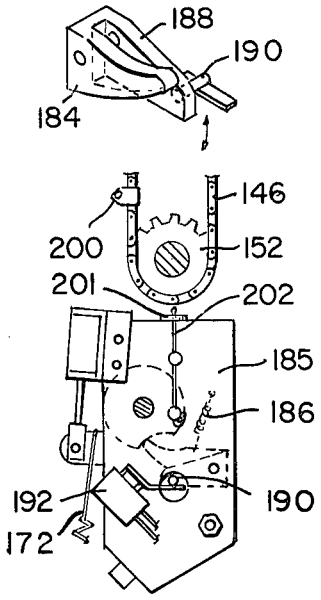
FIG. 10
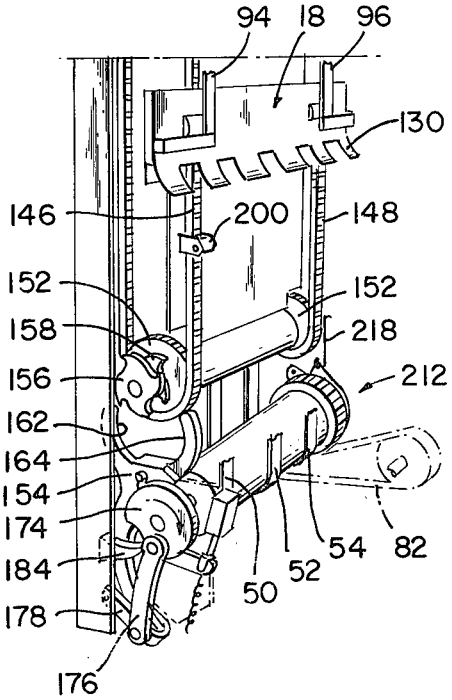
FIG. 8

COLLATOR

BACKGROUND OF THE INVENTION

This invention relates to sheet handling and, more particularly, to collators of the type which accept sheets from a printer, processing machine, feeder, copier, or by hand, one sheet at a time or as signatures, in multiples of the desired book or other document, and sort the sheets into one or more copies of the document or groups in individual bins or receiver trays ready for binding or other handling. The invention is illustrated and described herein with reference to acceptance of sheets from a copier of the type in which fresh sheets are supplied individually from a sheet holding cassette to a sheet input located adjacent one end of the copier with the sheets discharged from the copier at a sheet output also located adjacent the same end of the copier with the information bearing surface of the sheet oriented in a predetermined direction (e.g. face up).

Collators of the type to which this invention pertains typically are comprised of an infeed which accepts incoming sheets and a distributor which delivers sheets of paper from the infeed to an upright receiver which includes a vertical column of spaced shelves which form sheet receiver bins for reception and storage of the collated sheets delivered in proper order by the distributor. In one type of collator (hereinafter referred to as a "front entry" collator), the receiver bins are arranged to be fed from the front by the distributor and manually emptied from the rear or side when the collation process is complete. In this instance, the various sheets to be collated are fed in appropriate order by the copier, one sheet at a time, into the distributor and are conveyed by a suitable sheet conveyor along a vertical conveyor run adjacent the front side of the receiver in proximity to the respective inlets to the receiver bins. During the course of downward or upward movement on the vertical conveyor run, the sheets are deflected by a suitable sheet deflector mechanism onto the respective shelves of the receiver or into respective receiver bins by an indexing deflector assembly or individual deflector fingers, as the case may be. In this type of collator, sheets are accepted by the infeed adjacent the front side of the receiver. As a consequence, sheets which are delivered from the copier with a predetermined surface face up, for example, will be distributed into the receiver bins with the same predetermined surface also face up. The terms "front" and "rear" as used herein refer to opposite sides of the receiver, sheets being accepted adjacent the front side. These terms are not intended as constituting limitations to a particular direction of sheet movement or receiver orientation.

In another type of collator (hereinafter referred to as a "rear entry" collator to distinguish it from the aforementioned front entry collator), essentially the same distributor and sheet receiver are utilized, except that the receiver bins are arranged to be fed from the rear. Sheets are accepted by the infeed adjacent the front side of the receiver, are conveyed from the infeed over or under the receiver, and then along a vertical conveyor run adjacent the rear side of the receiver for distribution into respective receiver bins in the customary manner. In this instance, however, the sheets are assembled within the receiver bins inverted or upside down in relation to the surface orientation thereof when accepted by the infeed. In other words, in the rear entry type of collator, sheets which are delivered from the copier with a predetermined surface thereof face up will be assembled within the receiver bins with that surface face down.

SUMMARY OF THE INVENTION

This invention provides a rear entry collator which affords provides non-inverted assembled sheets and is comprised of a sheet receiver adapted to receive one or more sheets adjacent the rear side thereof, a sheet infeed operatively associated with the sheet receiver to accept one or more incoming sheets adjacent the front side of the receiver, and a sheet transport system for moving sheets from the infeed to the receiver in such a manner that the sheets will be received by the receiver in a surface orientation which corresponds to the surface orientation thereof when initially accepted by the infeed as incoming sheets. The receiver may include a single receiver bin or multiple receiver bins.

According to further aspects of the invention, the sheet transport includes a sheet conveyor for conveying a sheet along a course of travel in which the sheet is first moved in a direction opposite to its direction of movement when accepted by the infeed while maintaining essentially the same surface orientation, and then is moved in a reverse direction to return to movement in a direction corresponding to the infeed direction but in an orientation inverted with respect to its infeed orientation. Preferably, the sheet is positioned on an infeed support surface following acceptance by the infeed in overlying relation to the receiver. It is removed from the infeed support surface in the opposite direction and is deflected beneath the infeed support surface toward the rear side of the receiver and, depending upon the construction of the receiver, is moved along the rear side to a sheet reception position. According to one preferred embodiment, the sheet receiver includes an upright column of sheet receiver bins which open to the rear side thereof and, in this instance, the sheet conveyor provides sheet transport along a vertical course of travel adjacent the rear side of the receiver and facing the respective receiver bins. A sheet deflector operatively associated with the sheet conveyor deflects the sheet when moving along the aforementioned course of travel adjacent the rear side of the receiver (or the side adjacent which sheet reception takes place) toward the front side of the receiver (or the side adjacent which sheet infeed takes place) for reception thereby with the sheet having resumed a surface orientation corresponding to its surface orientation when accepted by the infeed. To provide sheet deflection with respect to the preferred multi-bin receiver, a deflector assembly is mounted for movement along the vertical course of travel and is selectively positionable at predetermined positions therealong for deflecting sheets therefrom into selected receiver bins.

According to still further aspects of the invention, the deflector assembly is moved between a predetermined series of index or deflector positions to deflect sheets to different ones of the receiver shelves by a torque response indexing assembly which is selectively coupled to a roller associated with the sheet conveyor at intervals for a time period sufficient to effect movement of the deflector from one index position to an adjacent index position. One preferred indexing assembly includes a rotatable cam which is clutch coupled to the conveyor roller at intervals. This cam rotates to move a pawl reciprocatively with respect to a ratchet assembly operatively connected to the deflector assembly to effect movement thereof. To provide bi-directional movement of the deflector assembly, the pawl may include two drive fingers which are operative with two oppositely acting ratchets, respectively. In this instance, the pawl is positioned so that each finger operates with its respectively associated ratchet to effect a series of indexing movements of the deflector assembly in a particular direction, followed by essentially continuous return movement thereof in the opposite direction, or to effect a series of indexing movements of the deflector assembly in one direction followed by a corresponding series of indexing movements thereof in the opposite direction. Other indexing assemblies suited for clutch coupling to the conveyor roller may be used.

The collator of the present invention may be used with a copier to effect duplex copy, separately or in combination with a single or multi-bin sheet receiver. The receiver includes sheet holding means such as an infeed cassette, and a sheet feed adapted to return feed a sheet from the sheet holding means or cassette to the copier sheet input to effect a duplex copy. Sheets are transported to the sheet holding means by the sheet transport described hereinabove and are assembled therein in a surface orientation which corresponds to their surface orientation when accepted at infeed. Preferably, the sheets are deflected to the sheet holding means or cassette by a second deflector assembly which, when utilized with a multi-bin receiver of the type described hereinabove, is located to selectively deflect sheets before arrival at a deflection position to a bin. The second deflector may be operated to deflect one or more sheets to make possible duplex copying, or it may remain inoperative, in which case sheets may be distributed to selected receiver bins. The movable deflector assembly may be made to index to an additional position in which sheets are deflected to the sheet holding means or cassette, in which case, the second deflector assembly may be eliminated.

To provide duplex copying in combination with a suitable commercial copier, the collator of this invention may utilize the aforementioned sheet holding means or cassette to receive and hold sheets for return feed to a copier with the copied or information bearing surface thereof in surface orientation corresponding to the surface orientation thereof when previously discharged from the copier and accepted by the collator infeed. Sheets thereupon may be refed into the copier for copying on the opposite non-copied blank surface thereof. As applied to copiers which produce sheets having the copied or information bearing surface thereof face up at discharge from the copier, for example, the collator of this invention may be utilized to distribute such sheets to a secondary infeed cassette in which sheets will be assembled in a face up disposition. Upon being returned to and recirculated through the copier in the customary manner, the sheets will be discharged with information copied on both sides thereof. At that point, the collator of this invention may be operated in its normal collate mode to distribute the now duplex copied sheets into the appropriate receiver bins for binding or other handling, as the case may be.

Of particular significance with respect to the preferred sheet deflector of this invention, is the indexing assembly. This assembly lends itself to economical manufacture and use in that it provides reduced magnitude force transmission during indexing movement of the deflector inasmuch as a force applied to effect deflector indexing may be applied at intervals in variable magnitude pulses. Until this invention, the stepping motors or conventional clutch/brake positioning apparatus which were used to effect deflector indexing tended to produce shock forces to start and stop the deflector assembly instantaneously. As a consequence, deflector mechanisms operated by such apparatus had to be constructed of components of excessive force bearing characteristics with concomitant uneconomical increase in the cost of the mechanism. The use of a simplified purely mechanical assembly for indexing the deflector therefore yields substantial manufacturing, operating and servicing economies.

As will be appreciated, multiple deflectors in the form of individual deflector fingers located adjacent respective receiver bins may be utilized instead of a single moveable deflector such as that described hereinabove. It will also be recognized that the receiver shelves or bins may be arranged in non-vertical columnar orientations in other applications, with appropriate modification in the orientation of the sheet transport or sheet conveyor for transporting sheets from the infeed to the inlet or inlets to the various receiver bins.

A further significant aspect of this invention is that each sheet is curved in opposite directions during movement by the preferred sheet conveyor—once when curved upon removal from the sheet support surface and again when curved to follow the vertical course of travel toward a deflection position. As a consequence, any tendency for the sheets to curl or retain a curved memory once assembled within the receiver is minimized or substantially eliminated.

These and other features, objects and advantages of the present invention will become apparent from the detailed description and claims to follow taken in conjunction with the accompanying drawings in which like parts bear like reference numerals.

BRIEF DESCRIPTION OF THE DRAWINGS

FIG. 7 is a section taken along the line 7—7 in FIG. 3;

FIG. 8 is a perspective of the FIG. 4 sheet transport indexing assembly;

FIG. 10 is a side elevational view taken with respect to line 10—10 in FIG. 7;

FIG. 11 is a perspective of the cam wheel stop member of the FIG. 8 indexing assembly;

DETAILED DESCRIPTION OF THE DRAWINGS

Figure 1:
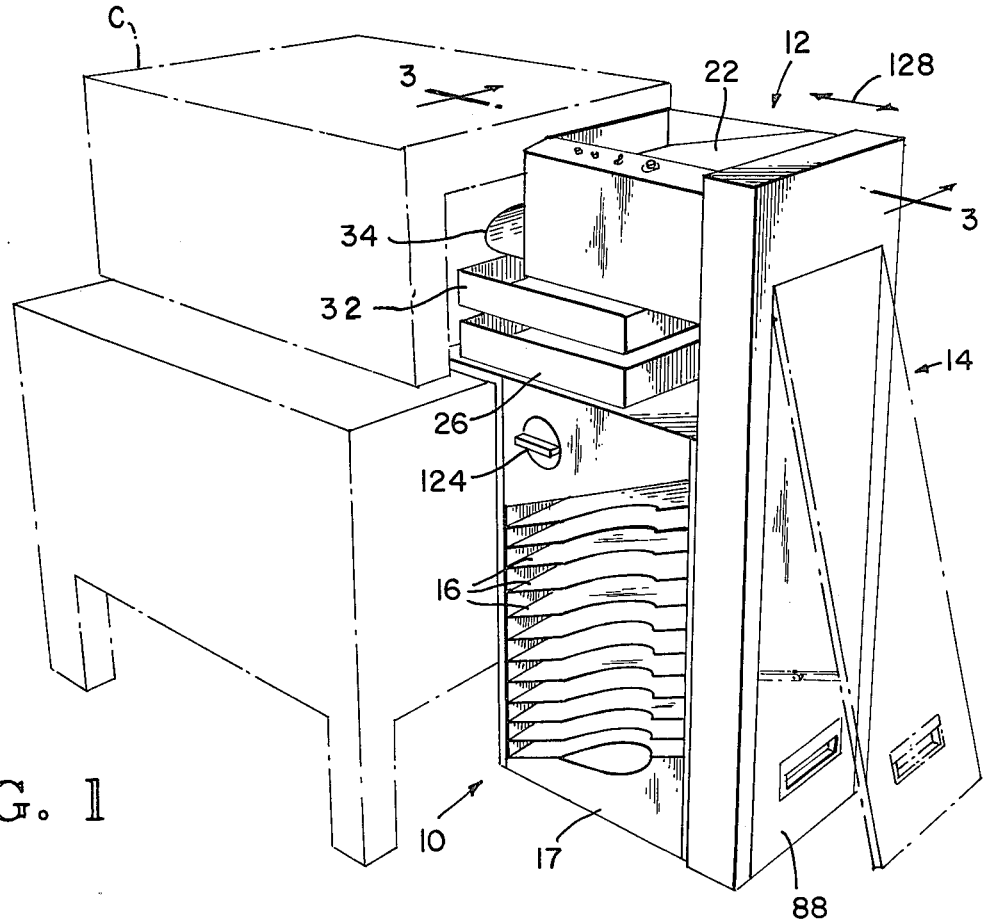
FIG. 1 is a perspective of the collator of this invention for providing 12 collated signatures or books or sheet groups, the collator being depicted to accept sheets from a table mounted copier and to return sheets to the copier for duplex copying.
Figure 2:
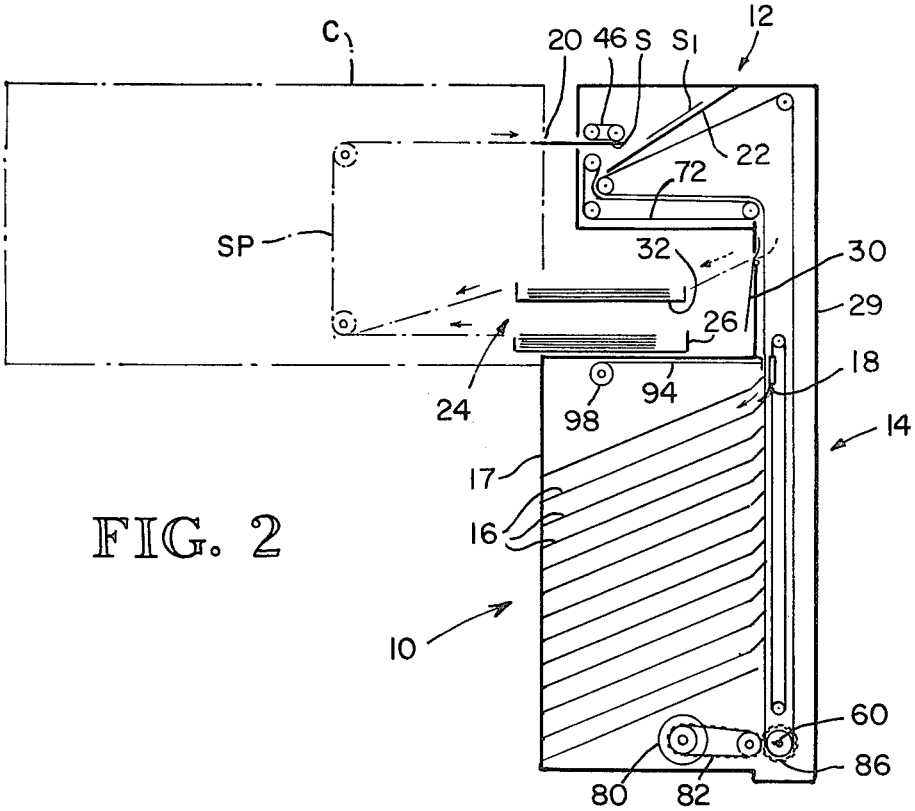
FIG. 2 is a schematic depicting operation of the FIG. 1 collator.
Figures 3, 5:
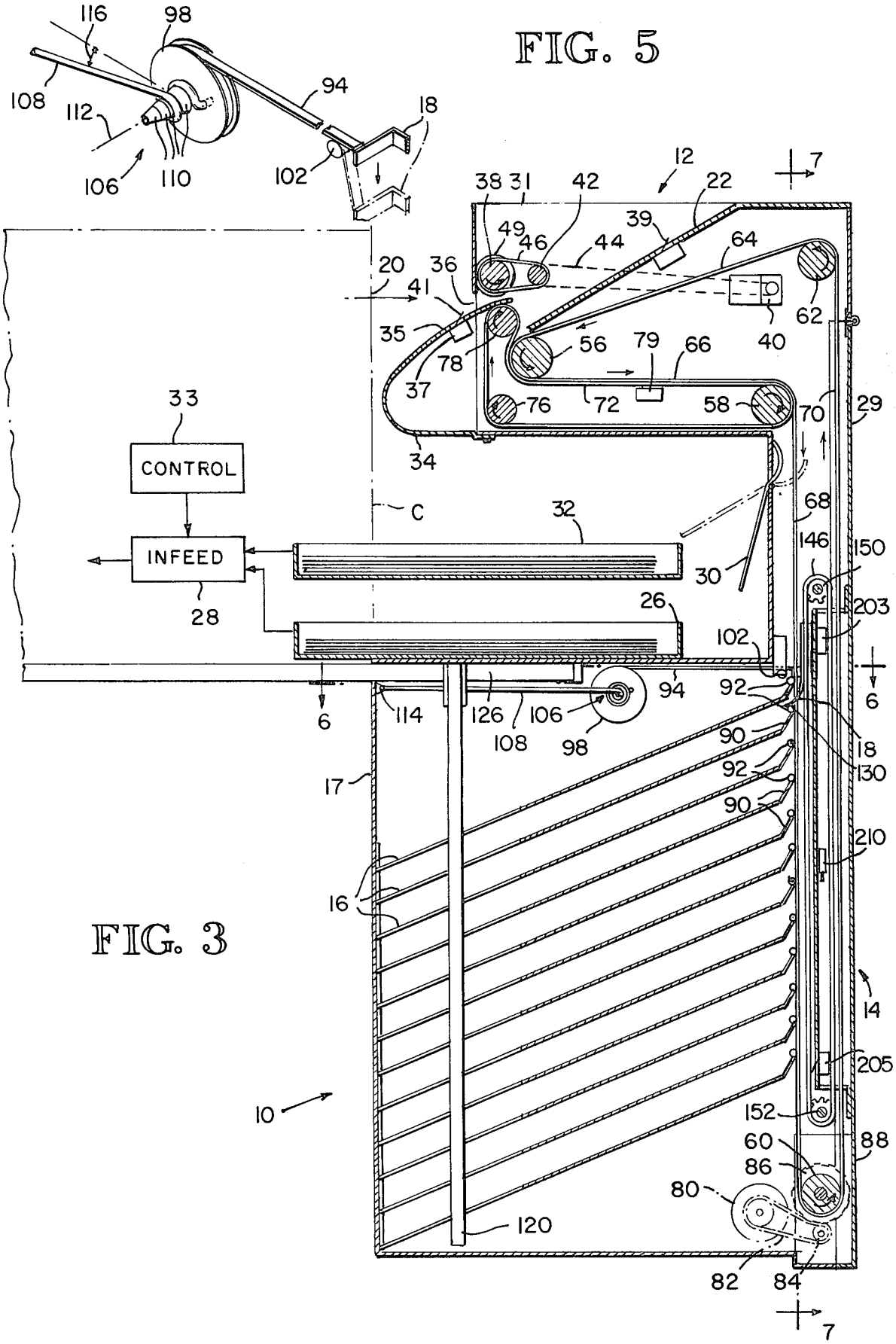
FIG. 3 is a section taken along the line 3—3 in FIG. 1.
FIG. 5 is a perspective of the sheet retaining tape assembly of the FIG. 4 sheet transport.

In general, the collator of the present invention includes a receiver section, an infeed section, and a distributor section (generally referenced by numerals 10, 12 and 14, respectively, in FIGS. 1–3). The receiver section includes an upright column of parallel spaced apart receiver shelves 16 which are mounted by housing 17 on an incline from the rear end of the receiver toward the front end thereof, as shown. The shelves form receiver bins or pockets therebetween for storage of sheets delivered thereinto from the rear side of the receiver section by a movable sheet deflector 18 (FIGS. 2 and 3) associated with the distributor section. The infeed section is disposed in overlying relation with the receiver section and accepts sheets adjacent the front side of the receiver section from a copier C, the output of which (referenced generally by numeral 20 in FIG. 2) is located in horizontal alignment with the infeed section. A sheet conveyor assembly moves sheets from the infeed section to the receiver section for deflection by deflector 18 into respective receiver bins in a non-inverted surface orientation relative to the surface orientation thereof when accepted by the infeed section.

Referring to FIG. 2, a sheet S is accepted by the infeed section as it travels in the direction indicated by the arrow toward the rear side of the receiver section, with initial sheet movement occuring in a generally horizontal direction, followed by upwardly inclined movement onto a proof tray 22, until the sheet is completely accepted by the infeed section. At that point, the sheet rests on proof tray 22, as depicted by sheet $S_1$. The opposed surfaces of sheets $S_1$ are now engaged adjacent the lower edge of the tray 22 by the sheet conveyor which removes it from tray 22 by movement in a downardly inclined direction toward the front end of the receiver section and inverts it to travel beneath tray 22. The sheet is now inverted with respect its orientation when accepted by the infeed section and is moved along a generally horizontal path toward the rear end of the receiver section, where it is curved again to a vertical position. The sheet is then directed downwardly along a vertical course of travel adjacent the rear side of the receiver section to face the respective entrances to the receiver bins. During its downward movement, the sheet is deflected by deflector 18 onto one of the shelves 16.

Deflector 18 is positionable at a predetermined series of positions which are aligned with the entrances to the various sheet receiver bins, respectively, to deliver sheets moving along the vertical course of travel in sequence to the various receiver bins. In FIG. 2, the deflector 18 indexes downwardly from one sheet receiver bin to the next lower receiver bin and, at completion of a chosen group of index positions, is recycled upwardly to return to a home position to begin the next collating cycle. The deflector may be recycled in a continuous series of steps without pausing at any index position to repeat a collating cycle, or it may be indexed upwardly in a similar manner by which it was indexed downwardly to repeat a collating cycle.

FIG. 2 illustrates in phantom, one copier machine which the collator of the present invention may be used to effect duplex copying, or to recirculate single copied sheets to copy on the opposite side thereof. The copier has a sheet inlet 24 and a sheet outlet 20 located above and adjacent the sheet outlet. Fresh sheets are supplied from a removable cassette 26 and positioned in operative relation with an appropriate infeed mechanism 28 (FIG. 3). Sheets are fed into the copier from the cassette by the infeed mechanism 28 and are transported through the copier along a sheet path SP, illustrated schematically in dotted lines in FIG. 2, and is discharged at outlet 20 inverted with respect to its surface orientation at inlet 24, with information or material copied to the sheet appearing on the upper sheet surface.

To provide duplex copying in cooperation with a copier of the type illustrated in FIG. 2, the collator of the present invention includes a transition housing 29 which mounts a second sheet deflector (generally referenced by numeral 30 in FIG. 2) which extends through an opening in the housing 29 for deflecting sheets into a supplemental infeed cassette, sheet receptacle or shelf 32 located above cassette 26 and operatively associated with the second sheet deflector for receiving sheets deflected from the vertical course at a location above the uppermost receiver bin or index position of deflector 18. Control means 33 (FIG. 3) are provided on the copier to control the infeed mechanism 28 to selectively infeed sheets from cassette 32 or supply cassette 26 to inlet 24. In FIGS. 2 and 3, deflector 30 is illustrated in dotted lines in its deflection sheet position and in solid lines in its non-deflection position. It is moved manually between these positions and retained in its deflection position by a ball-detent assembly (not shown), although it could be moved or positioned automatically by an appropriate control device.

In the illustrated deflection position of deflector 30, sheets will be diverted from the vertical course into cassette 32 as illustrated by the arrow. Sheets which are deposited in and received by cassette 32 and oriented with the information bearing or copied surface thereof in an orientation corresponding to the orientation thereof when accepted by the infeed section. In FIG. 2, for example, the sheets are received in cassette 32 with the copied or information bearing surface thereof face up. To provide duplex copying the sheet may be recirculated through the copier by appropriate operation of the infeed control mechanism to feed in sheets from cassette 32 to inlet 24. In this instance, the sheets are discharged at outlet 20 with the originally copied or information bearing surface thereof now face down and the second surface thereof bearing new copy and oriented face up. These sheets are accepted by the collator infeed section with both surfaces thereof copied and are collated in the manner described previously by repositioning the secondary deflector assembly in its non-deflecting position so that the duplex copied sheets are transported to deflector 18 for delivery to the receiver bins.

Referring now to FIG. 3 of the drawings, the infeed section includes an upper housing 31 having a nose cone 34 forming an upwardly inclined curved infeed surface 35 in horizontal alignment with copier outlet 20. The upper edge of the nose cone 34 projects through a horizontally elongated infeed slot 36 in housing 31 through which incoming sheets are accepted from the copier. An entry switch 37 is mounted by the interior of the nose cone beneath surface 35. A switch operator 41 extends through an opening (not shown) in surface 35 to operate switch 37 in response to passage of sheet S during infeed. Housing 31 additionally supports proof tray 22 which is downwardly inclined toward the front end of the housing to form an inclined sheet supporting surface on which sheets accepted via the infeed slot are deposited. A proof tray switch 39 is mounted beneath tray 22 for activation in response to deposit of sheet $S_1$ on tray 22. To aid the passage of sheets from the copier through the infeed slot and to insure correct positioning thereof on the proof tray, a powered entry roller 38 may be provided. This roller is mounted transversely within the housing 31 in overlying relation to the upper terminus of nose cone 34 rotation in the direction indicated by the arrow by an entry motor 40 mounted on the exterior of the housing. Motor 40 is connected to and rotates a drive roller 42 via drive belt 44. Roller 42 is spaced from roller 38 and is connected to and rotates roller 38 by drive belt 46. Spaced O-rings 49 (see FIG. 4) on roller 38 engage the upper surface of sheet S to propel it through slot 36 and onto tray 22.

Figure 4:
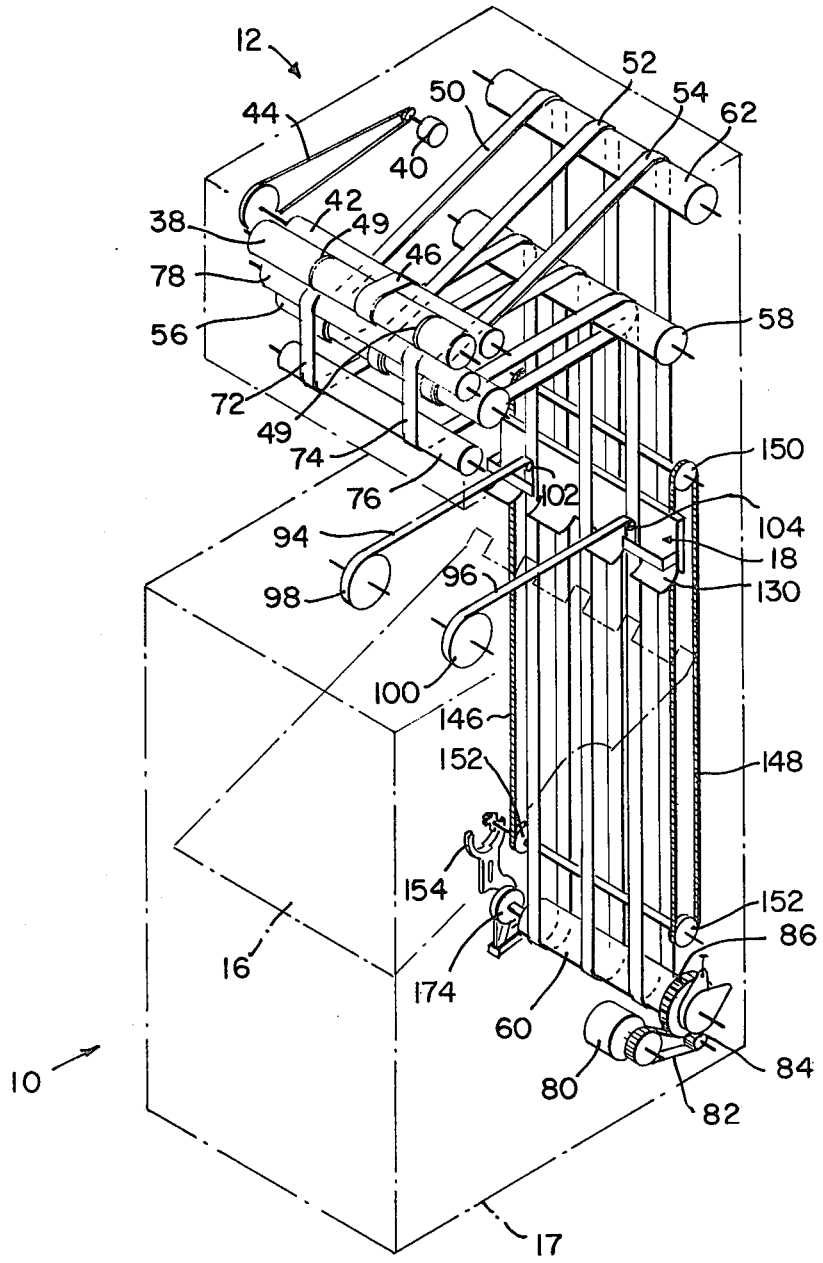
FIG. 4 is a perspective of the sheet transport of the FIG. 1 collator.

The sheet conveyor system of the present invention will now be described with specific reference to FIGS. 3 and 4. As illustrated in FIG. 4, the conveyor system includes three spaced apart, parallel, endless conveyor tapes 50, 52, 54 trained about four rollers 56, 58, 60, 62, as shown. As designated in FIG. 3, these conveyor tapes form an upper inclined run 64, a lower horizontal run 66, an inner vertical run 68, and an outer vertical run 70. The three conveyor tapes are moved to provide forwardly directed movement along run 64, rearwardly directed movement along run 66, downwardly directed movement along run 68, and upwardly directed movement along run 70, as indicated by the arrows. The conveyor system also includes two spaced apart parallel endless conveyor tapes 72, 74 (FIG. 4) trained about roller 58 and two additional vertically spaced apart rollers 76, 78. Tapes 72, 74 are located in the infeed section of the collator to provide sheet retention for sheets during transport within the receiver section, principally along run 66. For this reason, tapes 72, 74 are located in underlying face-to-face engagement with tapes 50 and 54, respectively, along run 66, as shown (FIG. 3) to hold a sheet thereon while moving along run 66. As most clearly illustrated in FIG. 3, tapes 72, 74 (tape 74 not shown) also are curved about a portion of the periphery of roller 56 so that they oppose tapes 50 and 54 adjacent the lower edge of tray 22. At this location, the tapes 50, 54 and 72, 74 grip the lower forward edge of sheet $S_1$ at its bottom and top surfaces thereof, to begin transport of the sheet to the distributor by curving it about roller 56 for subsequent movement along run 66. An index switch 79 is mounted beneath run 66 for operation in response to passage of a sheet therealong.

It will be recognized that the illustrated conveyor tapes may be positioned to diverge slightly in the direction of sheet movement along the various sheet runs illustrated in order to exert forces in the plane of each sheet to maintain the sheets flat during conveyance.

A conveyor motor 80 drives tapes 50, 52, 54 through roller 60. Tapes 50, 54 in turn drive tapes 72 and 74, respectively. Motor 80 is connected to roller 60 by drive belt 82 which rotates gear 84 mounted by the receiver housing 17. Gear 86, connected to roller 60, engages gear 84 to transmit power thereto. Roller 60 and gear 86 are mounted to a movable rear housing panel 88 which may be pivoted about its upper end to the open position depicted in broken lines in FIG. 1 to facilitate access to or inspection of the distributor section. In the open position of panel 88, gears 84 and 86 are disengaged and the conveyor system is inoperative.

Referring to FIGS. 3 and 4, and with particular reference to the inner vertical conveyor run 68, the receiver shelves each include spaced inclined end portions 90, the interior ones of which terminate in rounded or generally cylindrical tape guides 92 (see FIG. 3) which slidably bear against the forward surfaces of the conveyor tapes 50, 52, 54 and serve to retain sheets moving downwardly along the vertical conveyor run thereagainst.

To further retain sheets against the conveyor tapes along this vertical run, retractable retaining tapes 94, 96 (see FIG. 4 and 5) may be provided to oppose the forward faces of tapes 50 and 54, respectively, for holding a sheet thereon during downward movement thereof from the upper end of the bin column to a deflection position, or the position of deflector 18. Tapes 94 and 96, wound about spools 98 and 100, extend over stationary tape supports 102 and 104. The ends of tapes 94 and 96 are secured to and moveable with deflector 18 so that as deflector 18 is indexed downwardly, tapes 94, 96 are unwound from their respectively associated spools and are pulled downwardly by the deflector in face-to-face engagement with the forward faces of conveyor tapes 50, 54. Sheets moving down the vertical conveyor run are engaged by the rear faces of tapes 94 and 96 and are held in positive engagement with conveyor tapes 50, 54. As the deflector assembly is indexed upwardly toward its home position, the retaining tapes are retracted.

Referring now to FIG. 5, a tensioning assembly, generally referenced by numeral 106, exerts torque on each tape retaining spool for maintaining essentially constant tension in the unspooled portion of the retaining tape, irrespective of the length of tape unwound therefrom in relation to the index position occupied by deflector 18. Only the tensioning assembly and tape support associated with tape 94 are illustrated in FIG. 5, the other tensioning assembly and tape support associated with tape 96 being identical. The tensioning assembly illustrated includes an elastic cord 108 which is wrapped about a plurality of independently movable cone sections 110. These sections together form a continuous conical surface in coaxial alignment with the axis of rotation of spool 98, the axis referenced by numeral 112, in FIG. 5. The cord 108 is in turn secured at one end to the spool itself. The other end of cord 108 is secured to housing 17 by anchor 114 (FIG. 3) at a location offset with respect to the face of spool 98 to form a lead-in angle 116 (FIG. 5) relative thereto. The segmented nature of the conical surface about which the cord is wrapped, by virtue of the independent rotational movement of each cone section, allows the cord to shift with respect to axis 112 as greater or lesser amounts of tension are imposed thereon in relation to rotative motion of the spool. Consequently, the cord will assume positions at greater or lesser radial spacing with respect to axis 112 and the point at which it applies torque to spool 98 in order to maintain essentially constant torque thereon and hence constant tension in the unwound portions of the retaining tapes. Tension in the unwound portion of the retaining tapes may be controlled by appropriate selection of the lead-in angle 116 and the slope of the conical surface formed by section 110. Of particular significance in the present collator is that the tensioning assemblies maintain essentially constant tension in the unwound portions of the retaining tapes. As the deflector 18 assumes lower index positions, for example, the tension in the retaining tapes which must be overcome to unwind an additional length of tape in order to move deflector 18 downwardly to the next lower index position is essentially the same as that encountered when indexing from upper index positions.

It will be recognized that, in some applications, both retaining tapes and shelf guides 92 will be used, while in others only retaining tapes or only shelf guides 92 will be used. Other forms of sheet hold down also could be utilized. In the illustrated example as thus far described, it also will be appreciated that, during downward movement of sheets along run 68 from roller 58 to the uppermost bin or index position of deflector 18, no sheet retention force is applied to hold sheets on tapes 50, 52, 54. In this instance, deflector 30 is located a distance below roller 58 which is less than the length of the sheets being conveyed measured in the direction of movement thereof in order to insure positive deflection. The distance between roller 58 and the location along run 68 at which a sheet retention force is applied—by guides 92, or by tapes 72, 74, or both—should not be large enough to permit the sheets to lose contact with tapes 50, 52, 54. In other applications, of course, appropriate sheet retention may be provided along run 68 between roller 58 and the aforementioned location.

The illustrated inclined shelf construction of FIGS. 1–3 facilitates entry of the sheets into the receiver bins in that the force required to propel the sheets against the deflector 18 and thence into the receiver bins need not propel the sheet the entire length of the sheet receiving shelf. In most cases, the degree of inclination of the shelf is selected to cause the sheets to slide downwardly toward the front end of the receiver and, in this way, minimize the force required to propel the sheets into the bins. Horizontal shelves, of course, can be used in the present invention in order to reduce the height of the receiver section while maintaining the same number of receiver bins. In this instance, however, a larger force is required to propel the sheets into the bins, requiring the conveyor system to operate at a conveying speed somewhat higher than that employed with the illustrated inclined shelf construction. It will also be recognized that, in the illustrated inclined shelf construction, the sheets are assembled or grouped within the receiver bins in a inclined orientation and therefore are not in exact parallel alignment with the orientation thereof when accepted from copier C by the infeed section. The same surface orientation is maintained, however, to the extent that sheets accepted with a predetermined surface thereof face up are received by the receiver bins with the same predetermined surface also face up. This also is the case when horizontal shelves are utilized where the sheets are assembled or grouped within the receiver bins in essentially parallel alignment with sheets when accepted by the infeed section.

A vertical back bar 120 is mounted by the top panel of housing 17 and extends downwardly through the vertically aligned openings 122 in the shelves 16. The back bar is reciprocated by an adjustment mechanism which is manually controlled from the exterior of the receiver housing by an operator 124 illustrated in FIG. 1. The back bar is positioned by operator 124 in accordance with the length of the sheets being handled. Preferably, the back bar is a substantially rigid member which merely engages and terminates downward sliding movement of the sheets upon reception within the receiver bin, although other types of back bars could be used in the present invention. To facilitate access or inspection of the infeed and receiver sections, the collator may be mounted by slides 126 (FIG. 3) to move in and out with respect to copier c in a direction indicated by the arrow referenced 128 in FIG. 1.

Figure 6:
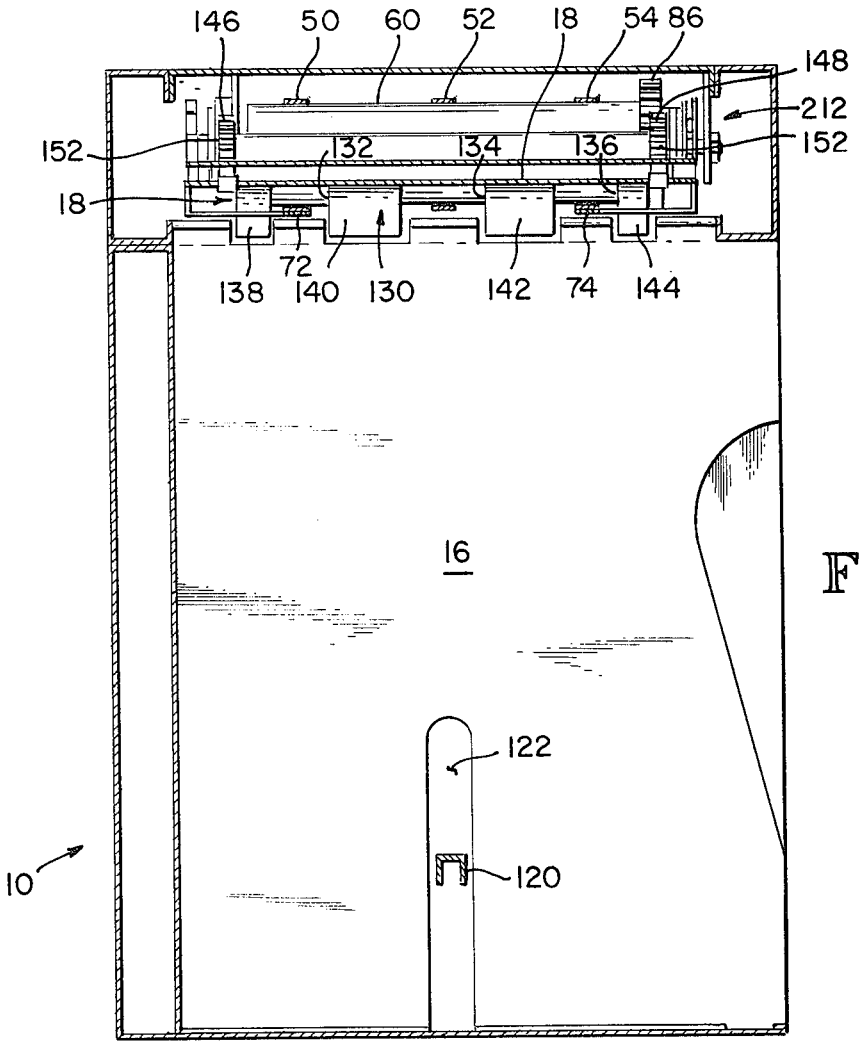
FIG. 6 is a section taken along the line 6—6 in FIG. 3.

The sheet deflector assembly will now be described with specific reference to FIGS. 3–17. Referring first to FIGS. 4 and 6, deflector 18 has a curved insertion portion 130 which is of sufficient length to intersect the sheet path followed by sheets moving along the vertical sheet run 68. The insertion portion includes three spaced apart generally rectangular openings 132, 134, 136 which are aligned with and are of sufficient width to permit passage of the three conveyor tapes 50, 52, 54 therethrough. The intervening portions 138, 140, 142, 144 of the deflector member have outlines which register with the outlines of respectively opposed cutouts in the receiver shelves 16 as most clearly illustrated in FIG. 6. Thus, when the deflector is indexed to a deflection position adjacent the inlet to a particular bin, the deflector member portions 138, 140, 142, 144 are in alignment with these shelf cutouts so that an essentially continuous deflection surface is formed by the deflection member and the intervening portions of the shelves. The deflector is mounted at its ends by two spaced apart parallel endless chains 146, 148 which are supported by upper and lower shaft supported sprocket wheels 150 and 152, respectively, such that rotation of the sprocket wheels causes the deflector to be moved up or down relative to the receiver bins as described hereinabove.

Figure 17:
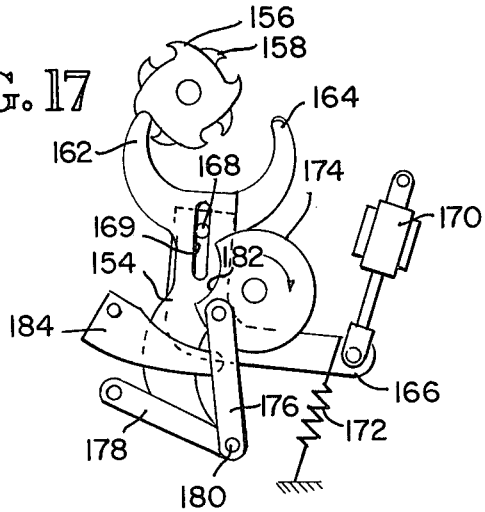

In the illustrated example, the lower sprocket wheel 152 is driven by an indexing assembly which includes a torque responsive actuator adapted to apply a force to wheel 152 for moving the deflector a predetermined distance from one deflection or index position to an adjacent deflection or index position, together with a clutch assembly for selective coupling of the actuator assembly to the lower conveyor roller 60 for application of torque produced by rotation of roller 60 for a time period sufficient to effect such movement of the deflector. Referring first to FIGS. 7 and 8, the actuator includes a reciprocatively movable pawl 154 and a ratchet mechanism made up of oppositely acting ratchets 156, 158 for rotating the lower chain sprocket 152 to move the deflector in opposite directions responsive to a force applied by pawl 154. The pawl terminates in two oppositely curved finger members 162, 164, the distal ends of which are offset transversely with respect to one another for engagement with ratchets 156, and 158, respectively. The pawl in turn is operated so that its fingers are positionable to engage the respectively associated ratchet in alternate sequence. As illustrated finger 162 is adapted to engage ratchet 156 to effect downward movement of the deflector, whereas finger 164 is adapted to engage ratchet 158 to effect upward movement of the deflector. A direction control member 166 is connected to the pawl by a pin 168 which rides in an elongated slot 169 extending along a portion of the length of the pawl, as most clearly illustrated in FIGS. 12–17, to control the disposition of the pawl fingers with respect to the ratchet assembly. A direction control solenoid 170 is connected to member 166 to apply a force thereto when energized to cause finger 164 to be aligned for engagement with ratchet 158, as depicted in FIG. 13 for upward deflector movement. A counteracting tension spring 172 is connected to member 166 for applying an opposing force thereto for moving the pawl so that finger 162 is aligned for engagement with ratchet 156, as depicted in FIG. 17, to effect downward deflector movement. When solenoid 170 is de-energized, spring 172 urges the pawl to the FIG. 17 position. In this position, as mentioned hereinabove, the deflector will be indexed downwardly.

Pawl 154 is guided by pin 168 to reciprocate along a rectilinear path which lies to one side or the other of the axis of rotation of the ratchet assembly, depending upon the position of pin 168. Pawl 154 is moved along this path in response to a force transmitted by a link assembly which is driven by a rotatable cam 174. This cam is rotatable about the axis of rotation of the conveyor roller 60 and is rotated when the aforementioned clutch assembly is engaged as will be described hereinafter. The link assembly which connects the drive wheel to the ratchet is made up of a crank 176 and a mounting link 178 which are connected at a common pivot point 180 to the lower end of the pawl. Rotation of cam 174 in a clockwise direction as viewed in FIG. 12, therefore, will reciprocate pawl 154 in a generally vertical direction and, depending upon the position of member 166, will cause one of its fingers to engage the appropriate ratchet to effect movement of the deflector. Cam 174 includes a detent 182 which is engagable with a spot member 184 illustrated in FIG. 11. This member is mounted pivotally by plate 185 and is urged by spring 186 (FIG. 10) to bear against the periphery of cam 174 so that it will swing vertically to engage the detent 182 when cam 174 assumes its FIG. 12 or FIG. 16 positions. As most clearly illustrated in FIGS. 10 and 11, the member 184 includes an arm 188 which mounts an operator pin 190 which projects transversely through an opening in plate 185 to operate cam switch 192 mounted on the opposite side thereof for purposes that will be described presently.

Figure 12:
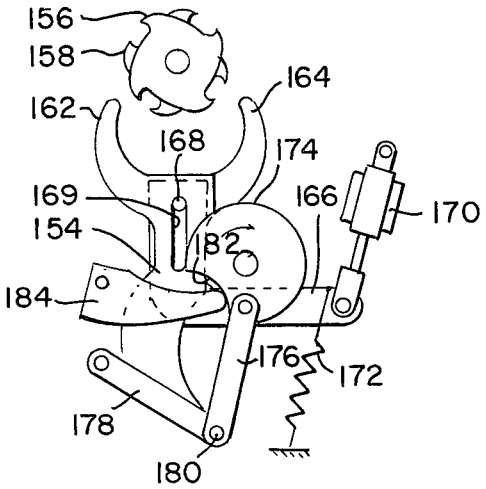
FIGS. 12-17 are schematics depicting operation of the FIG. 8 indexing assembly.
Figure 13:
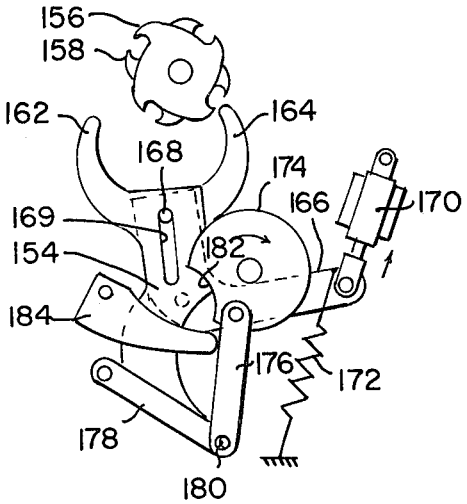
Figure 14:
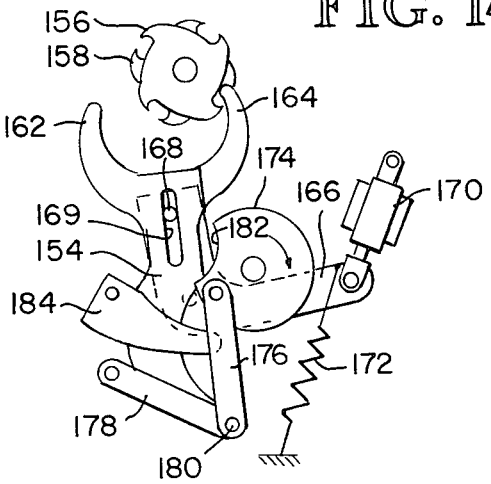
Figure 15:
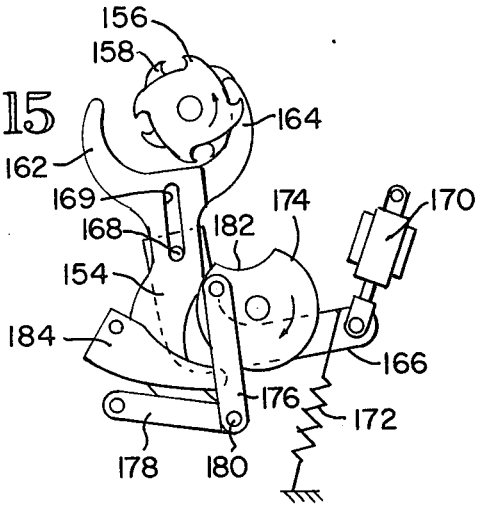
Figure 16:
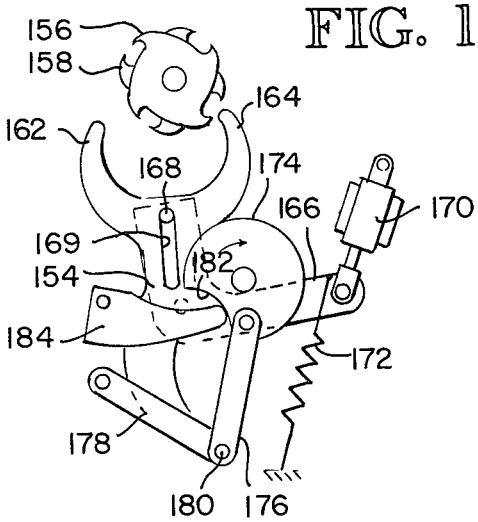

Operation of the indexing mechanism is illustrated schematically in FIGS. 12–17. In FIG. 12, the pawl is illustrated in its neutral position wherein the opposed pawl fingers are equally spaced from the ratchet assembly and pin 168 is located such that the elongated pawl slot 169 is aligned with its length coinciding with an axis which intersects the rotational axis of the ratchet assembly. In the neutral FIG. 12 position, the stop member is engaged within the cam detent and the cam is located approximately 10° before top-dead-center. FIG. 13 depicts the cam at its top-dead-center position, which it assumes upon commencement of rotation and operation of solenoid 170 to cause the ratchet assembly to be rotated in a direction for moving the deflector in an upward direction back toward its home position. In FIG. 13, member 166 has been moved by operation of the solenoid 170 to shift pin 168 with respect to its FIG. 12 neutral position to orient slot 169 with its length offset to one side of the rotational axis of the ratchet assembly (to the left as illustrated in FIG. 13). Pawl finger 164 now is aligned to engage ratchet 158 upon advancement of the pawl along an essentially rectilinear path to the position illustrated in FIG. 14 in response to continued rotation of the cam in the direction indicated by the arrow. In FIG. 14, pawl finger 164 has made initial engagement with ratchet 158 to rotate it. During rotation of the cam from the position illustrated in FIG. 13 to that of FIG. 14, solenoid 170 remains energized so that member 166 is maintained in the illustrated position to maintain the pawl in alignment with the ratchet assembly. With continued rotation of the cam, the pawl is moved toward its fully advanced position illustrated in FIG. 15 wherein the ratchet assembly is rotated a sufficient distance to cause the deflector member to be indexed upwardly a distance corresponding to the distance between two adjacent deflector or index positions. Cam 174 continues to rotate toward its FIG. 16 "home" position, where member 184 again engages the detent, as shown. In the event the deflector member is to be recycled to its home position, the aforementioned movement of the cam wheel is repeated while solenoid 170 remains energized until the deflector member reaches its home position.

To move the deflector member in a downward direction between a predetermined series of index positions, the pawl is positioned at its FIG. 17 position in response to the force exerted by spring 172 on member 166 to move and main members 166 and pin 168 where in a position slot 169 coincides with an axis offset to the opposite side of the axis of rotation of the ratchet assembly (in the illustrated example to the right thereof). In this instance, solenoid 170 is de-energized, as will be described. In FIG. 17, finger 162 is aligned with the oppositely acting ratchet 156. When the pawl is moved in a manner identical to that illustrated in FIGS. 13–16 in response to rotation of cam 174, finger 162 engages ratchet 156 to rotate the sprocket in a direction to effect downward deflector movement.

Referring to FIG. 10, two stop members 200, (only one shown) are mounted by chain 146 at spaced apart locations. One stop member is mounted by chain 146 to engage an operator 202 mounted by plate 185 which projects through an opening (not shown) in angle portion 201 of member 166 when the deflector has reached the last station or lowermost deflection position adjacent the lowermost receiver bin. Stop member 200, when engaged with operator 202, causes member 166 to be moved toward the FIG. 12 neutral position where the pawl fingers are equally spaced from the ratchet assembly. As a consequence, continued rotation of the cam causes the pawl to reciprocate out of contact with the ratchet assembly. A generally similar stop member (not shown) is mounted to engage operator 202 when the deflector reaches its home or uppermost position. When one of the two stop members engages operator 202, the pawl is maintained at its neutral position regardless of any force then being applied by the solenoid 170 or spring 172 to member 166. To disengage either stop member from operator 202 in order to permit the pawl to move to a non-neutral or active position wherein one of its fingers is aligned to engage the respectively associated ratchet, the following reversal operations are employed. When the deflector is in the last station position, solenoid 170 is energized to overcome the bias of spring 172 to move member 166 to its FIG. 13 position. When the deflector is in its home position, however, the solenoid 170 is de-energized and the force of spring 172 causes member 166 to be moved to its FIG. 17 position. Referring again to FIG. 3, a home switch 203 and a last station switch 205 are operated when the deflector assumes its home position and last station positions, respectively.

Referring to FIG. 7, to provide positive and accurate positioning of the deflector at the various indexing positions thereof, the lower sprockets are mounted on a shaft 204 which in turn mounts a square positioning block 206. This block is mounted in coaxial alignment with shaft 204 with its side surfaces in transverse alignment therewith. A spring biased positioning member 208 bears against the side surfaces of the block. The side surfaces of block 206 are so configured that rotation of the block 90° corresponds to movement of the deflector member between two adjacent index positions. Thus, the positioning member will bear against successive side surfaces of the block to apply a force for maintaining and accurately positioning the deflector at each index position.

The spacing between the distal ends of pawl fingers 162, 164 and the ratchet assembly as illustrated in FIGS. 13 and 17 is exaggerated for clarity. In most practical cases, this spacing should be minimized by appropriate construction of cam 174 and the drive link assembly which moves pawl 154 so that fingers 162, 164 make initial contact with the respectively associated ratchet once cam 174 is rotated to a position approximating or slightly beyond top-dead-center. This will allow the pawl to gain sufficient momentum to impart an increasing force to the ratchet assembly to commence rotation thereof; but will minimize or eliminate impact forces incident to initial contact by the pawl therewith. As a consequence, noise and vibration forces are minimized or eliminated.

Figure 9:
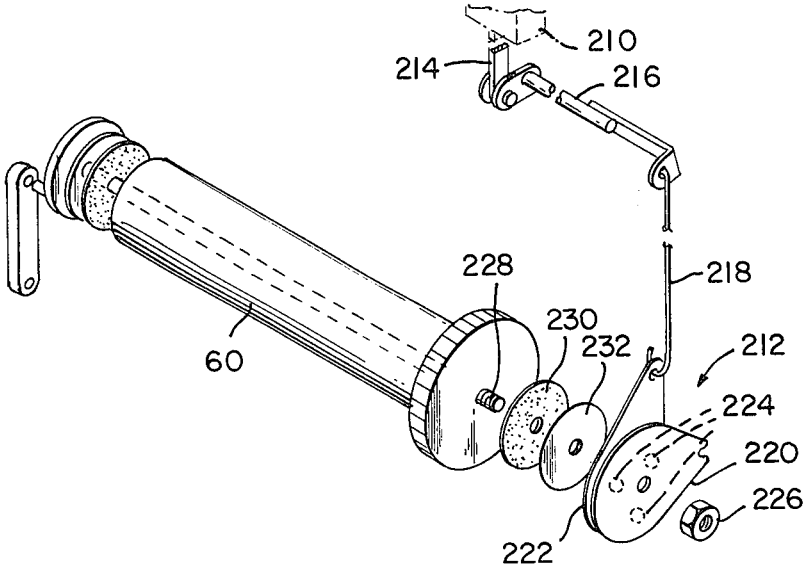
FIG. 9 is a perspective of the FIG. 8 indexing assembly clutch mechanism and lower guide roller of the FIG. 4 sheet transport.

The clutch assembly for transmitting rotational effort to the cam 174 from conveyor roller 60 will now be described with specific reference to FIGS. 7 and 9. The clutch assembly is operated by an index solenoid 210 mounted in underlying relation to the main sheet conveyor tapes as illustrated in FIG. 7 and is connected to a friction clutch 212 by a link assembly composed of an upper pull link 214, a pivotal intermediate link 216, and a lower pull link 218. When the index solenoid is operated, it draws the pull link 214 upwardly, causing link 216 to rotate so as to in turn pull pull link 218 in an upward direction. Referring now in particular to FIG. 9, link 218 is connected to and operates clutch 212, which includes an outer plate 220 and an inner plate 222, both of generally circular outline. These plates are positioned in face-to-face relation with three cam balls 224 mounted therebetween in respective inclined races. Plate 220 is fixed to the receiver housing whereas plate 222 is connected to and is moveable by link 218 to shift rotatively with respect to plate 220 about an axis which coincides with the rotational axis of the roller 60. Such relative movement of plates 220 and 222 causes balls 224 to shift in their respective races so as to apply an axial force to plate 220 which in turn is transmitted by a nut 226 to a rod 228 on which it is threadably secured. Rod 228 extends axially through roller 60 and terminates at the opposite end thereof in connection with cam 174. Opposed friction pads 230, 232 are mounted in coaxial relation with rod 228 to be brought into frictional engagement with one another in response to application of an axial force transmitted from plate 220 and, when engaged, transmit rotational effort from roller 60 to rod 228 to cause cam 174 and roller 60 to rotate conjointly.

Figure 18:
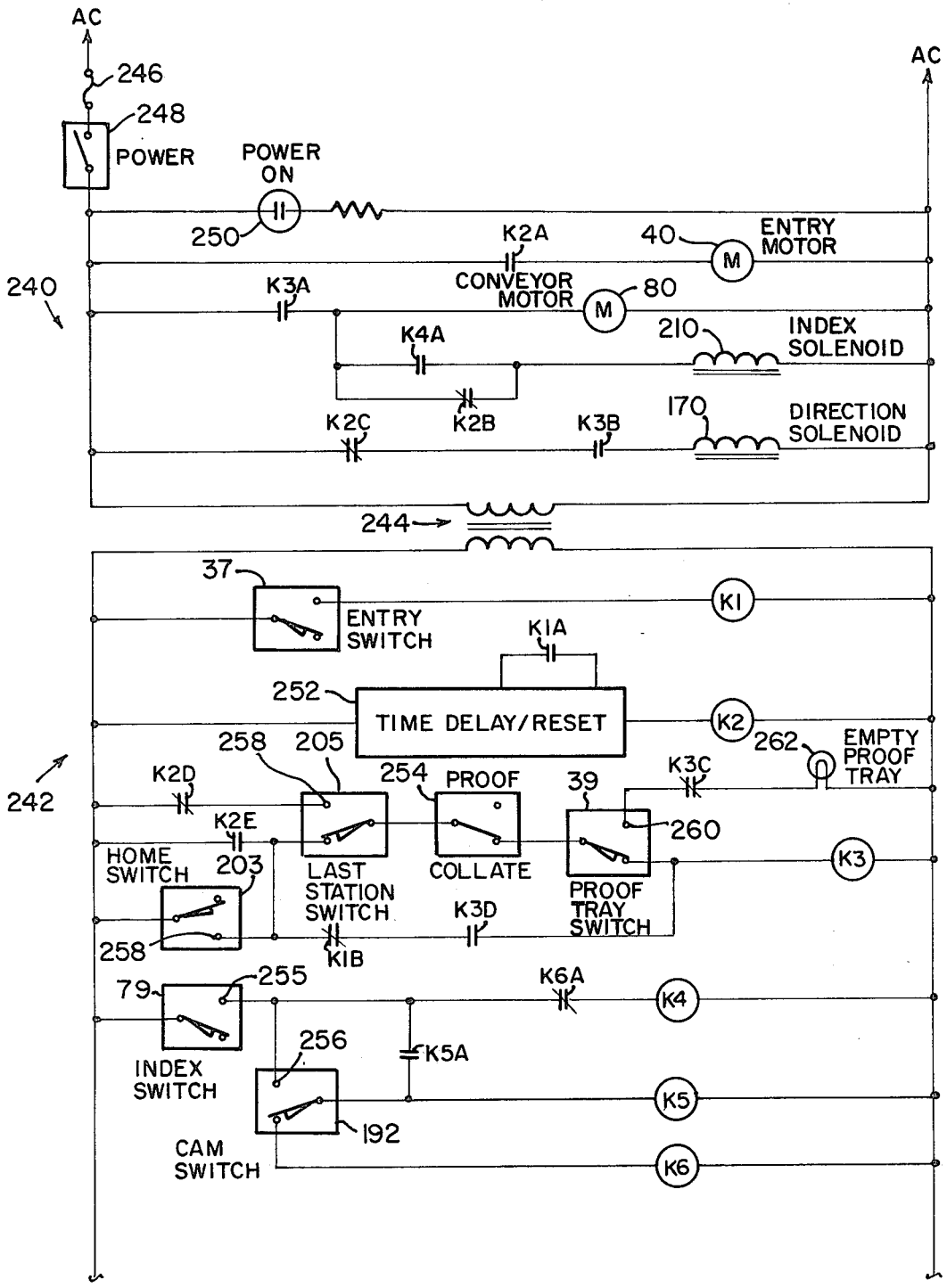
FIG. 18 is an electrical schematic of a control circuit for the FIG. 1 collator.

Referring now to FIG. 18, an electrical circuit suitable to control the collator of the present invention includes a motor control circuit 240 and a relay control circuit 242 which are coupled inductively by step down transformer 244. The FIG. 18 circuit controls indexing of the deflector 18 in response to passage of a sheet along FIG. 3 run 66 as sensed by the index switch 79. In the illustrated circuit, the home position of deflector 18 corresponds to a position located one index position above the position at which a sheet will be deflected into the uppermost receiver bin. The deflector is indexed downwardly from its home position to this first deflection position, followed by successive downward indexing movements in response to passage of subsequently accepted sheets, respectively. Upon assuming its last station position, corresponding to a deflection position at which a sheet will be deflected into the lowermost receiver bin, or upon assuming an intermediate position for a predetermined time period during which no sheet is accepted, the deflector is recycled to its home position by effecting a continuous series of upward indexing movements.

Referring to FIG. 18, the electrical circuit depicted schematically therein is connectable to a source of alternating current electrical power by an appropriate fuse 246 and includes a power switch 248 which, when closed, delivers alternating current to the remaining circuit elements. With the power switch in its closed position, a power-on indicator 250 is energized. The FIG. 18 circuit remains in a quiescent mode with only the power-on indicator operative until a sheet is accepted from the copier by the infeed section. At that time, entry switch 37 is operated responsive to acceptance of an incoming sheet from the copier. When operative, entry switch 37 energizes relay K1, closing contacts K1A and opening contacts K1B. contacts K1A are connected to a delay/reset circuit 252 which operates relay K2 and maintains it operational for at least five seconds, or until a successive sheet is accepted by the infeed. (Acceptance of a subsequent sheet by the infeed causes the time delay of circuit 252 to be reset.) Upon passage of the incoming sheet through infeed station inlet 36, (FIG. 3) switch 37 returns to the illustrated open position and relay K1 is de-energized, opening contacts K1A and closing contacts K1B. Circuit 252, however, maintains a current path to relay K2 for 5 seconds after opening of contacts K1A. While energized, relay K2 closes contacts K2A, opens contacts K2B–K2D, and closes contacts K2E. Closure of contacts K2A causes the entry motor 40 to be energized to drive the entry roller 38 (FIG. 3). The sheet now is deposited on the proof tray to operate switch 39 to the position illustrated, whereupon a current path is established through now closed contacts K2E, last station switch 205 (in the illustrated position), a proof/collate switch 254 (in the collate position), and proof tray switch 39 to relay K3. Relay K3 now closes contacts K3A, opens contacts K3B and K3C, and closes contacts K3D. Closure of contacts K3A causes conveyor motor 80 to be energized to drive the FIG. 4 conveyor tapes 50, 52, 54. Closure of contacts K3D establish a holding path to relay K3 via contacts K3D and now closed contacts K1B and K2E, which path circumvents switch 39. Thus, upon opening of switch 39 responsive to removal of the sheet from the proof tray during conveying toward FIG. 3 run 66, relay K3 remains energized. The index switch 79 is operated as the sheet is conveyed along run 66 and transfers to establish a current path via its contact 255 and normally closed relay contacts K6A to relay K4. With the sheet still in operative contact with switch 79, relay K4 closes contacts K4A which, together with previously closed contacts K3A, provide a current path to the index solenoid 210. The cam 174 associated with the indexing mechanism now begins to rotate to commence downward movement of the deflector, causing the cam switch 192 to transfer to make contact with its contact 256 for energizing relay K5. This relay is latched in an energized condition by the holding path established through now closed contacts K5A of relay K5 and the still closed switch 79. Upon completion of a full cycle of revolution of the cam 174, the cam switch returns to the illustrated contact condition to provide an energizing circuit to relay K6 via the index switch and relay contacts K5A and switch 79, provided the sheet has not yet completed its travel along run 66. Contacts K6A are thereupon opened to cause relay K4 to drop out, opening contacts K4A to cause the index solenoid to return to its de-energized condition. As soon as the sheet clears the index switch, the index switch returns to the illustrated normally open position and causes relays K5 and K6 to drop out. It will be recognized that, inasmuch as the home position of the deflector is located one index position above the first or uppermost receiver bin, the first sheet of paper which is accepted by the infeed section from the copier will cause the deflector to be moved downwardly from the home position to an index position associated with the uppermost receiver bin. As a consequence, the first sheet accepted is received by the first or uppermost receiver bin. The aforementioned sequence of operations is repeated in response to acceptance of each subsequently received sheet. In the event duplex copies are to be made, deflector 30 is moved to its deflection position and the sheet will be deflected to cassette 32 instead of a receiver bin. In this instance, the deflector 18 will, in the circuit of FIG. 18, be indexed downwardly although the circuit could be modified to prevent movement of deflector 18 in this instance. To prevent movement of the deflector while operating the collator in a proof mode wherein sheets are accumulated on the proof tray without further conveyance, switch 254 may be transferred to its proof position.

To recycle deflector 18 following a series of downward indexing movements in the event the number of successive sheets accepted by the infeed section is less than the total number of receiver bins, the circuit 252 causes relay K2 to drop out five seconds after the last sheet has been delivered to its respective receiver bin. Contact K2E is now opened to break the holding path via contacts K1B and K3D to relay K3. Relay K3, however, remains operative because the home switch 203 (illustrated in the position assumed with the deflector 18 at its home position) establishes an alternate holding path to relay K3 via its contact 258, and contacts K1B and K3D. De-energization of relay K2 again causes contacts K2B to close for operating the index solenoid, and additionally causes the direction solenoid 170 to be operated via now closed contacts K2C and K3B. Both control solenoids, namely the index solenoid and the direction solenoid, are now operative along with the conveyor motor. This causes the index mechanism to resume operation to index the deflector in an upward direction to return it toward its home position in a continuous series of upward indexing movements. When the deflector reaches its home position, the home switch 203 is transferred back to its normally open position illustrated, thereby interrupting the holding path through contacts K1B and K3D to relay K3. Relay K3 is now de-energized, thereby opening contacts K3A and K3B. The conveyor motor, the index solenoid and the direction solenoid are now de-energized.

In the event the number of successive sheets accepted by the infeed section is equal to the number of receiver bins, the aforementioned sequence of operations is repeated, except that the last station switch 205 is operated in response to arrival of the deflector at the last station corresponding to an index position adjacent the lowermost receiver bin. When operated, this switch transfers to effect contact with contact 258. In this instance, relay K3 remains operative because of the holding path established through the home switch and relay contacts K1B and K3D. The recycle sequence, therefore, is identical to that previously described.

In the event the number of successive sheets accepted by the infeed section is greater than the number of receiver bins, however, acceptance of the excessive number of sheets by the receiver section again causes the entry switch to energize relay K1 to open relay contacts K1B. Relay K3 thereupon is de-energized to open contacts K3A and, as a consequence, the conveyor motor 40 is de-energized. The thirteenth sheet and all subsequently received sheets will thus remain in the proof tray. In this instance, the proof tray switch 39 transfers to effect contact with respect to contact 260 to energize the proof tray light 262 via normally closed contacts K3C. The oerator is thus notified that more than one sheet is presently accumulated within the proof tray and that this condition must be corrected by removal of all sheets from the proof tray before beginning the next collating sequence, at which time the tray switch transfers back to the illustrated normally closed position. Relay K3 is now re-energized and a holding path is re-established thereto via the home switch 203 and the previously described contacts K1B and K3D. The conveyor motor, index solenoid and direction solenoid are now re-energized simultaneously, as described previously so that the aforementioned recycle sequence may be repeated to return the deflector toward its home position.

The FIG. 18 circuit may be modified to index the deflector 18 in response to passage of a sheet into a receiver bin or into cassette 32, or may be modified to provide jam protection, or both. Indexing movement may be controlled, for example, by establishing a light beam adjacent the FIG. 3 conveyor run 68 such that this beam will be interrupted by passage of a deflected sheet to initiate an indexing sequence. To this end, a light source may be mounted adjacent the last station or lowermost bin within the receiver section, and a photocell or appropriate light detector may be mounted above FIG. 3 roller 58. With such a circuit, the home position of deflector 18 corresponds to its uppermost deflection position and indexing movement thereof does not occur until the first sheet accepted has been received by the uppermost receiver bin. To respond only to deflection of a sheet by deflector 18 into a receiver bin, the light detector may be mounted between deflector 30 and the home position of deflector 18. In this case, deflector 18 is not indexed downwardly during operation of deflector 30 to effect duplex copies. According to this modification, the index switch 79 is eliminated.

To provide jam protection, the FIG. 18 circuit may include an additional timing circuit to maintain the conveyor motor energized for a predetermined time period which corresponds to the time normally required for a sheet to traverse the light beam. Thus, in the event of a jam condition in which a sheet does not clear the light beam within this time period, the conveyor motor is de-energized until the jam condition is corrected.

It also will be recognized that the FIG. 18 circuit may be further modified to provide upward indexing movement of the deflector between a series of index positions to deflect sheets into respective receiver bins. In this instance, upon assuming its last station position or a position at which the last sheet to be collated has been accepted, the deflector is indexed upwardly to the adjacent index position to deflect the next sheet in the series and the aforementioned indexing cycle is repeated in an upward direction until the deflector resumes its home position.

Although one preferred embodiment of the present invention has been illustrated and described herein, variations will become apparent to one of ordinary skill in the art. Accordingly, the invention is not to be limited to the specific embodiments illustrated and described herein, and the true scope and spirit of the invention are to be determined by reference to the appended claims.

The embodiments of the invention in which an exclusive property or privilege is claimed are defined as follows:

1. A collator, comprising: sheet receiver means for receiving a sheet adjacent one side thereof; sheet infeed means including a sheet support surface and means for positioning an incoming sheet thereon operatively associated with said sheet receiver means for accepting an incoming sheet adjacent the side of said receiver means opposite the one side thereof; sheet conveyor means for engaging the sheet positioned on said support surface to remove said sheet therefrom by movement in said opposite direction; and then moving the sheet in a direction corresponding to its direction of movement when accepted by said sheet infeed means while maintaining an inverted surface orientation, and sheet deflector means operatively associated with said conveyor means for deflecting a sheet moving along said course of travel adjacent the one side of said receiver means for reception by said receiver means with said sheet having resumed its corresponding surface orientation, wherein said sheet conveyor means include a sheet conveyor assembly which comprises opposed moveable conveyor tape means for engaging opposed surfaces of a sheet positioned on said sheet support surface to move said sheet in said opposite direction while curving said sheet until inverted and underlying said sheet support surface for movement in said corresponding direction toward the one side of said receiver means, and wherein one of said conveyor tape means include a portion continuing along the one side of said receiver means in a direction substantially perpendicular to said corresponding direction toward said deflector means, and wherein said receiver means include a column of spaced bins having inlets which face the one side of said receiver means; said sheet deflector means include a moveable sheet deflector assembly operatively associated with said continuing conveyor tape means portion, means mounting said deflector assembly for movement along said course of travel, and means for positioning said deflector assembly along said course for deflecting sheets therefrom into selected ones of said bins; and said sheet conveyor assembly includes sheet retaining means for holding a sheet on said continuing conveyor tape means portion for movement to the position at which it is deflected.

2. A collator comprising: (a) sheet receiver means, including a column of spaced bins, for receiving a sheet adjacent one of the means' sides; (b) sheet infeed means, including a sheet support surface and means for positioning an incoming sheet onto the support surface, operatively associated with the sheet receiver means; (c) sheet conveyor means, including opposed, moveable conveyor tapes for engaging opposed surfaces of the sheet positioned on the sheet support surface, for moving the sheet in a direction opposite its entry while curving the sheet until the sheet inverts and underlies the sheet support surface, whereupon the sheet will once again move in the same direction as its entry, wherein one conveyor tape includes (i) a portion which continues along one side of the receiver means in a direction substantially perpendicular to the entry position and (ii) sheet retaining means for holding the sheet on the tape when it moves toward a sheet deflector assembly; and (d) a sheet deflector means (i) operatively associated with the conveyor means for deflecting a sheet moving along the conveyor means into the sheet receiver means so that the sheet will have resumed its orientation at entry and (ii) including a moveable sheet deflector assembly, means for mounting the assembly to allow the assembly to move along the conveyor tape, and means for positioning the assembly to allow deflection of sheets into selected bins, wherein said sheet retaining means include retaining tape means connected at one end to said deflector assembly in face-to-face proximity with said continuing conveyor tape to the position at which a sheet is deflected, and means for extending and retracting said sheet retaining means with movement of said deflector assembly while maintaining constant tension thereon.

3. A collator comprising: (a) sheet receiver means, including a column of spaced bins, for receiving a sheet adjacent one of the means' sides; (b) sheet infeed means, including a sheet support surface and means for positioning an incoming sheet onto the support surface, operatively associated with the sheet receiver means; (c) sheet conveyor means, including opposed, moveable conveyor tapes for engaging opposed surfaces of the sheet positioned on the sheet support surface, for moving the sheet in a direction opposite its entry while curving the sheet until the sheet inverts and underlies the sheet support surface, whereupon the sheet will once again move in the same direction as its entry, wherein one conveyor tape includes (i) a portion which continues along one side of the receiver means in a direction substantially perpendicular to the entry position and (ii) sheet retaining means for holding the sheet on the tape when it moves toward a sheet deflector assembly; and (d) a sheet deflector means (i) operatively associated with the conveyor means for deflecting a sheet moving along the conveyor means into the sheet receiver means so that the sheet will have resumed its orientation at entry and (ii) including a moveable sheet deflector assembly, means for mounting the assembly to allow the assembly to move along the conveyor tape, and means for positioning the assembly to allow deflection of sheets into selected bins, wherein said sheet retaining means include retaining tape means connected at one end to said deflector assembly in face-to-face proximity with said continuing conveyor tape to the position at which a sheet is deflected, and means for extending and retracting said sheet retaining means with movement of said deflector assembly while maintaining constant tension thereon, and means upstanding from said bins column adjacent the bin inlets to apply a sheet holding force in cooperation with said retaining tape means.

4. A collator comprising: (a) sheet receiver means, including sheet holding means for holding at least one sheet for return feed into a copier whereupon the sheet is returned opposite in orientation to its entry, for receiving a sheet adjacent one of the means' sides; (b) sheet infeed means, including a sheet support surface and means for positioning an incoming sheet onto the support surface, operatively associated with the sheet receiver means; (c) sheet conveyor means, including opposed, moveable conveyor tapes for engaging opposed surfaces of the sheet positioned on the sheet support surface, for moving the sheet in a direction opposite its entry while curving the sheet until the sheet inverts and underlies the sheet support surface, whereupon the sheet will once again move in the same direction as its entry, wherein one conveyor tape includes (i) a portion which continues along one side of the receiver means in a direction substantially perpendicular to the entry position and (ii) sheet retaining means for holding the sheet on the tape when it moves toward a sheet deflector assembly; and (d) a sheet deflector means (i) operatively associated with the conveyor means for deflecting a sheet moving along the conveyor means into the sheet receiver means so that the sheet will have resumed its orientation at entry and (ii) including a moveable sheet deflector assembly operatively associated with said continuing conveyor tape, and means mounting said deflector assembly to selectively deflect sheets from said continuing conveyor tape into said sheet holding means at a single position spaced along said continuing conveyor tape.

5. The collator of claim 2 wherein the receiver means further includes sheet holding means above the upper end of said bin column for holding at least one sheet for return feed into a copier, and wherein the sheet deflector means further includes:

an additional moveable sheet deflector assembly operatively associated with said continuing conveyor tape, and means mounting said additional deflector assembly to selectively deflect sheets from said continuing conveyor tape into said sheet holding means at a single position spaced along said continuing conveyor tape above the upper end of said bin column.

6. The collator of claim 5, wherein said sheet retaining means include means upstanding from said bin column adjacent the bin inlets for engaging said continuing conveyor tape to apply a sheet holding force.

7. The collator of claim 5, wherein said means for positioning said deflector assembly include torque response drive means operatively connected to said mounting means for applying a force to move said deflector assembly a predetermined distance along said course of travel from one deflection position to an adjacent deflection position, and torque application means operatively associated with said sheet conveyor means for applying torque to said drive means for a time period sufficient to effect movement of said deflector assembly over said predetermined distance.

8. The collator of claim 7, wherein said conveyor means include a roller adapted to be rotated during operation of said conveyor means, and wherein said torque application means include clutch means for selectively coupling to said roller to apply torque to said drive means.

9. The collator of claim 8, wherein said drive means include a pawl having a drive finger, a rotatable cam connected to said clutch means for rotative coupling to said roller, means connecting said cam and said pawl for moving said pawl reciprocatively in response to rotation of said cam, and a ratchet assembly adapted to be driven in response to engagement with said drive finger to effect movement of said deflector assembly.

10. The collator of claim 8, wherein said drive means include a pawl having two spaced apart drive fingers, a rotatable cam connected to said clutch means for rotative coupling to said roller, means connecting said cam and said pawl for moving said pawl reciprocatively in response to rotation of said cam, a bi-directional ratchet assembly adapted to be driven in opposite direction in response to engagement with said two drive fingers, respectively, to effect bi-directional movement of said deflector assembly, and control means operatively associated with said pawl for controlling engagement of said drive fingers with said ratchet assembly to control the direction of movement of said deflector assembly.

11. The collator of claim 2, wherein said sheet retaining means include means upstanding from said bin column adjacent the bin inlets to apply a sheet holding force in cooperation with said retaining tape means.

12. The collator of claims 2, 3, or 11, wherein said means for extending and retracting said retaining tape means include means for spooling and retaining tape means about an axis of rotation and a tape tension control assembly connected to said spooling means to apply a constant torque thereto as the diameter of the spooled retaining tape means changes responsive to extension and retraction thereof, said tape tension control assembly including a plurality of independently movable cone segments which together form a segmented cone surface in coaxial relation with said axis of rotation, and an elastic cord member convoluted about said cone surface and connected at one end to said spooling means to apply a constant torque thereto as it is stretched about said cone surface and allowed to shift along said axis to bear upon different cone segments during unspooling of said retaining tape means.

13. A collator for use with a copier to duplex copy, the collator comprising: sheet receiver means for receiving a sheet adjacent one side thereof; a sheet support surface, means for positioning an incoming sheet from a copier adjacent the side of said receiver means opposite the one side thereof; sheet conveyor means operatively associated with said receiver means and said sheet support surface for engaging the sheet positioned on said support surface to remove said sheet therefrom by movement in said opposite direction while maintaining its surface orientation and then moving said sheet in a direction corresponding to its direction of movement when accepted by said sheet support surface while maintaining an inverted surface orientation; and sheet deflector means operatively associated with said conveyor means for returning the sheet copied on one surface from said receiver means to the copier adjacent the opposite side of the receiver by deflecting the sheet moving along said course of travel adjacent the one side of said receiver means for reception by said receiver means with said sheet having resumed its corresponding surface orientation to effect a copy on the opposite surface thereof.

14. The collator of claim 13, wherein said sheet support surface is inclined downwardly from the one side of said receiver means toward the opposite side thereof, and wherein said sheet conveyor means include a sheet conveyor assembly which comprises opposed movable conveyor tape means for engaging opposed surfaces of a sheet positioned on said sheet support surface adjacent the lower terminus thereof to move said sheet in said opposite direction while curving said sheet until inverted and underlying said sheet support surface for movement in said corresponding direction toward the one side of said receiver means.

15. The collator of claim 13, wherein said sheet conveyor means include a sheet conveyor assembly which comprises opposed movable conveyor tape means for engaging opposed surfaces of a sheet positioned on said sheet support surface to move said sheet in said opposite direction while curving said sheet until inverted and underlying said sheet support surface for movement in said corresponding direction toward the one side of said receiver means.

16. The collator of claim 15, wherein one of said conveyor tape means include a portion continuing along the opposite side of said receiver means in a direction substantially perpendicular to said corresponding direction toward said deflector means.

17. The collator of claim 16, wherein said receiver means including sheet holding means for holding at least one sheet for return feeding into a copier in said corresponding surface orientation, and said sheet deflector means include a moveable sheet deflector assembly operatively associated with said continuing conveyor tape means portion, and means mounting said deflector assembly to selectively deflect sheets from said continuing conveyor tape means portion into said sheet holding means at a single position spaced along said continuing conveyor tape means.

18. A method of making duplex copies, comprising: receiving a sheet adjacent one side of a sheet receiver: accepting said incoming sheet from a copier adjacent the side of the receiver opposite the one side thereof; positioning said incoming sheet on a sheet support surface; engaging the sheet positioned on said support surface to remove said sheet therefrom by movement in said opposite direction; moving a sheet from the opposite side of the receiver to the one side thereof for reception thereby in a surface orientation which corresponds to the surface orientation of said sheet when accepted from the copier while curving said sheet until inverted and underlying said sheet support surface for movement in said corresponding direction toward the one side of the receiver; and returning said sheet copied on one surface thereof from the receiver to the copier adjacent the opposite side of the receiver while maintaining said corresponding surface orientation to effect a copy on the opposite surface of said sheet.

19. Apparatus for use with a sheet conveyor for holding a sheet on a movable conveyor tape for movement along a course of travel to a position at which it is deflected by a sheet deflector assembly movable along the course of travel, the apparatus comprising: retaining tape means connected at one end to said deflector assembly in face-to-face proximity with the conveyor tape to the position at which a sheet is deflected, means for spooling said retaining tape means about an axis of rotation; a tape tension control assembly connected to said spooling means to apply a constant torque thereto as the diameter of the spooled retaining tape means changes responsive to extension and retraction thereof, said tape tension control assembly including a plurality of independently movable cone segments which together form a segmented cone surface in coaxial relation with said axis of rotation, and an elastic cord member convoluted about said cone surface and connected at one end to said spooling means to apply a constant torque thereto as it is stretched about said cone surface and allowed to shift along said axis to bear upon different cone segments during unspooling of said retaining tape means.

* * * * *